United States Patent [19]

Kawarabashi

[11] Patent Number: 4,878,342

[45] Date of Patent: Nov. 7, 1989

[54] TWO-FOR-ONE TWISTING MACHINE

[75] Inventor: Tsukasa Kawarabashi, Kyoto, Japan

[73] Assignee: Murata Kikai Kabushiki Kaisha, Kyoto, Japan

[21] Appl. No.: 217,837

[22] Filed: Jul. 12, 1988

[30] Foreign Application Priority Data

Jul. 21, 1987 [JP] Japan ..... 62-181931

[51] Int. Cl.[4] ..... D01H 1/10; D01H 9/02; D01H 9/18

[52] U.S. Cl. ..... 57/58.49; 57/266; 57/281; 242/18 DD; 242/35.5 A; 242/46

[58] Field of Search ..... 57/266, 267, 281, 58.49, 57/58.52, 62, 313; 242/35.5 A, 18 DD, 46

[56] References Cited

U.S. PATENT DOCUMENTS

| | | | |
|---|---|---|---|
| 2,743,061 | 4/1956 | Kingsbury | 242/18 DD |
| 3,552,666 | 1/1971 | Stenmans et al. | 242/18 DD X |
| 3,860,186 | 1/1975 | Schiltknecht et al. | 242/18 DD X |
| 4,006,864 | 2/1977 | Tooka | 242/35.5 A X |
| 4,055,937 | 11/1977 | Latus et al. | 57/58.49 X |
| 4,125,990 | 11/1978 | Stahlecker et al. | 242/35.5 A X |
| 4,126,279 | 11/1978 | Munnekehoff | 242/18 DD |
| 4,139,162 | 2/1979 | Stahlecker | 242/35.5 A |
| 4,165,046 | 8/1979 | Suzuki et al. | 242/35.5 A |

FOREIGN PATENT DOCUMENTS

| | | | |
|---|---|---|---|
| 955484 | 1/1957 | Fed. Rep. of Germany | 57/62 |
| 16850 | 4/1913 | France | 242/18 DD |
| 2455559 | 11/1980 | France | 242/18 DD |
| 782917 | 9/1957 | United Kingdom | 242/18 DD |
| 815649 | 7/1959 | United Kingdom | 242/18 DD |

*Primary Examiner*—Joseph J. Hail, III

*Attorney, Agent, or Firm*—Spensley Horn Jubas & Lubitz

[57] ABSTRACT

A two-for-one twisting machine including a plurality of twister units arranged in a back-to-back relationship in two rows in constituted such that a support shaft extends above friction rollers in each of the rows of the twister units and individual cradle arms are supported turnably at base end portions thereof on one of the support shafts on the back side.

10 Claims, 5 Drawing Sheets

TWO-FOR-ONE TWISTING MACHINE

FIELD OF THE INVENTION AND RELATED ART STATEMENT

The present invention relates to a two-for-one twisting machine, and more particular to a construction of a winding device of the two-for-one twisting machine.

A two-for-one twisting machine is normally composed of a twisting machine portion for imparting twists to a yarn (in a narrow sense, the twisting machine portion may sometimes be called two-for-one twisting machine) and a winding machine portion for taking-up a yarn thus twisted. Such a two-for-one twisting mechine is constituted as a single machine wherein a plurality of twister units are provided in a back-to-back juxtaposed relationship in two rows.

The winding machine portion is generally composed of a feed roller for forwarding a twisted yarn to the winding machine portion, a cradle arm for supporting a winding package thereon, a friction roller for contacting with the winding package to provide a turning force to the package, and so on.

Conventionally, if a winding package has been put into a fully wound condition, an operator will lift the cradle arm to cancel the contacting condition between the friction roller and the winding package and pull the fully wound package off from the cradle arm and then carry the package away from there.

The development of the technique according to the present invention has started for the object of reducing such a great amount of labor of an operator with a view to provision of an automatic transporting means which takes the place of such transportation of a fully wound package by the operator as described above. Upon development of such transporting means, it has been in the thought of the inventor of the present patent application that an existing twisting machine may not be changed significantly and that addition of the transporting means will not significantly increase the size of the double twisting machine.

As a technique which satisfies the two requirements, the inventor of the present patent application has intended to propose a technique that a conveyor is disposed linearly at an intermediate position between two rows of machine frames arranged in a back-to-back relationship at an upper location of the two-for-one twisting machine, that is, at an intermediate position between winding packages on two rows of machine frames arranged in a back-to-back relationship such that fully wound packages may be discharged onto the conveyor and transported on the conveyor to an end portion of the rows of the machine frames so that they may be collected there.

However, the intermediate position is conventionally occupied by cradle arms or a support shaft for such cradle arms and has no spacing in which winding packages can be placed or transported. Particularly, it is almost impossible to transport winding packages having a large diameter of wound yarn due to structural reasons of the same.

OBJECT AND SUMMARY OF THE INVENTION

It is an object of the present invention to provide such an intermediate position as described above with a spacing sufficient to accommodate therein a winding package having a large diameter of wound yarn.

According to an embodiment of the present invention, a two-for-one, twisting machine of the type wherein a plurality of twister units are arranged in a back-to-back relationship in two rows, is constituted such that a support shaft extends above friction rollers in each of the rows of the twister units over the two-for-one twisting machines with the plurality of twister unit, and individual cradle arms are supported for pivotal motion at base end portions thereof on one of the support shafts on the back side.

DETAILED DESCRIPTION OF THE PREFERRED EMBODIMENTS

Figure 5:
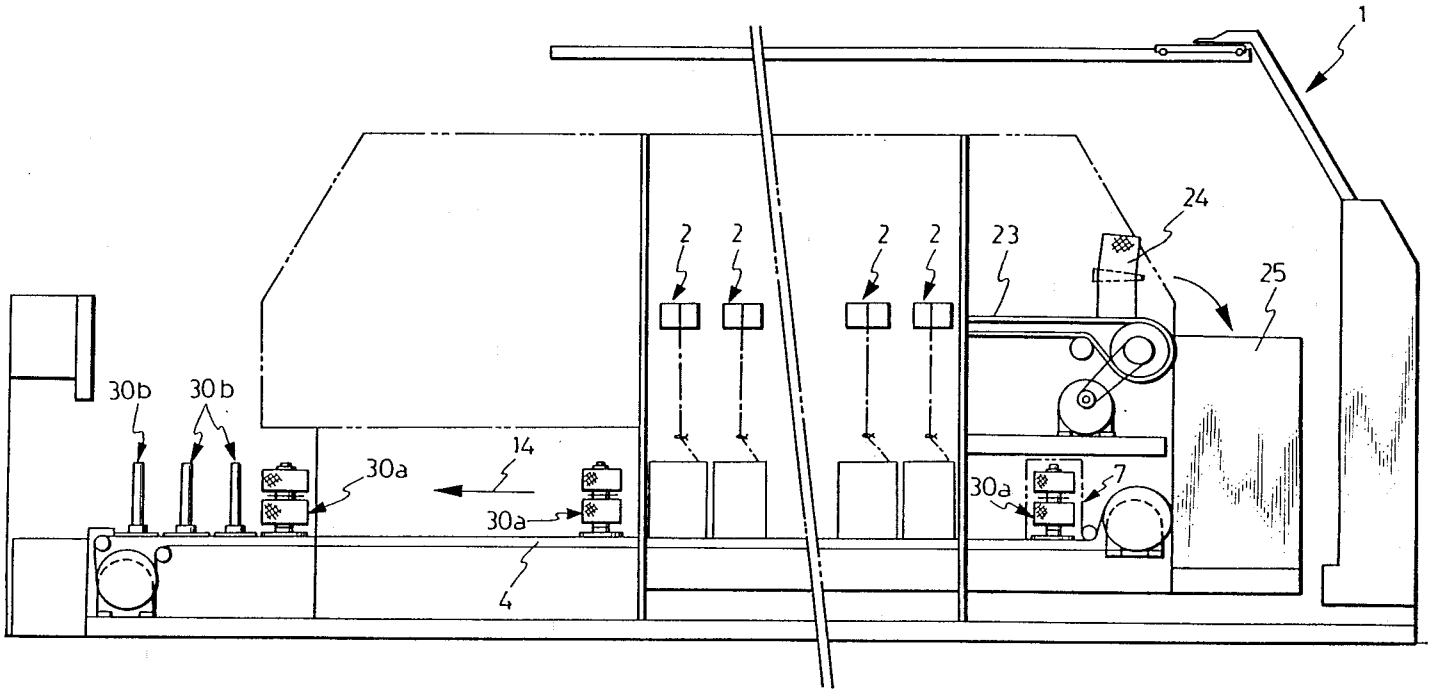
Figure 6:
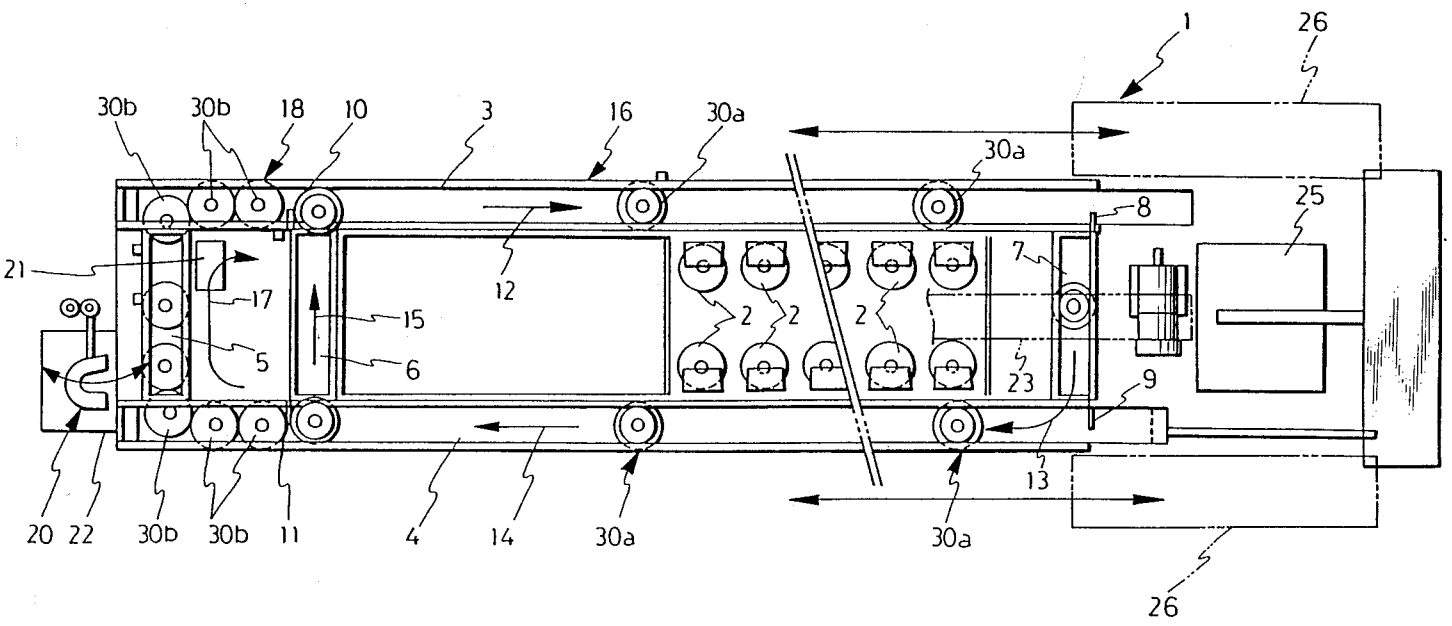

A two-for-one twisting machine 1 according to the present invention is shown in FIGS. 5 and 6. In the two-for-one twisting machine 1, a large number of two stage yarn supply type two-for-one twisters (hereinafter referred to only as two-for-one twisters) 2 are disposed in a back-to-back relationship in two rows. A pair of conveyors 3 and 4 extend on the opposite outer sides of the two rows of the two-for-one twisters 2 arranged in a back-to-back relationship, and short conveyors 5, 6 and 7 are installed between the long conveyors 3 and 4 such that they may interconnect the long conveyors 3 and 4. A pair of immovable stoppers 8 and 9 are disposed at locations at which the long conveyors 3 and 4 intersect the short conveyor 7, and a pair of movable stoppers 10 and 11 are disposed similarly at locations at which the long conveyors 3 and 4 intersect the short conveyor 6. The movable stoppers 10 and 11 can selectively assume two positions including a position in which they extend above the long conveyors 3 and 4, respectively, and another position in which they are retracted from the long conveyors 3 and 4, respectively. The movable stoppers 10 and 11 normally assume the position in which they extend above the long conveyors 3 ad 4, respectively, thereby allowing formation of a circulating line 16 for feeding an article in the direction indicated by arrow marks 12, 13, 14 and 15 and an exchanging line for feeding an article in the direction indicated by an arrow mark 17. In FIGS. 5 and 6, reference numeral 20 denotes a yarn supply package exchanging device, 21 a yarn end finding device, 22 an empty bobbin receiving box, 23 a transport conveyor for a wound up package 24, 25 a wound up package receiving box, and 26 an automatic package exchanging machine which reciprocates along the long conveyor 3 or 4.

An article to be fed is composed of a transport medium (hereinafter referred to as tray) 30 and a pair of yarn supply packages Pa and Pb.

Figure 1:
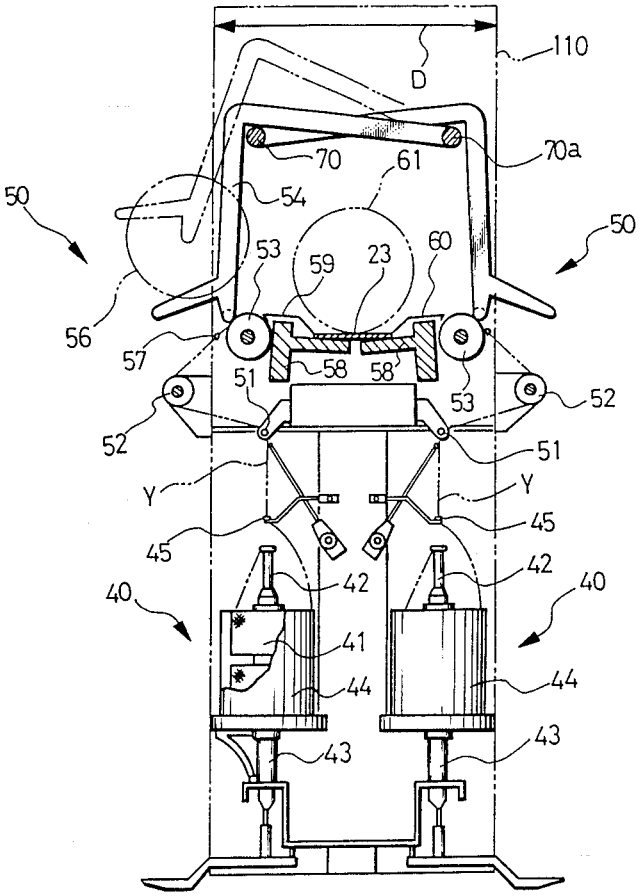
FIG. 1 is a front elevational view showing twister units of a two-for-one twisting machine to which an embodiment of the present invention is applied, FIG. 2 a front elevational view showing construction of a cradle arm, FIG. 3 a plan view similarly showing the cradle arm, FIG. 4 a schematic front elevational view for explaining movement and a moment force of a weight, FIG. 5 a side elevational view of a two-for-one twisting machine according to an embodiment of the present invention, and FIG. 6 a plan view of the same.

FIG. 1 shows a pair of opposing ones of the two-for-one twisters 2 described above. Each of the two-for-one twisters 2 is composed of a known yarn twisting station 40 and a winding station 50. A yarn Y released from a yarn supply package 41 passes a tenser body 42 and a hollow portion of a spindle 43 and is introduced outwardly from a yarn introducing hole of a rotary disk not shown whereafter it is passed through a balloon guide 45 while being ballooned under the control of a balloon controlling ring 44 and then fed to the winding station 50.

At the winding station 50, the yarn Y having passed the balloon guide 45 is guided by a yarn guide 51 and forwarded therefrom by a feed roller 52. Reference numeral 53 denotes a friction roller which is rotating positively, and the friction roller 53 contacts under pressure with a take-up tube 55 or a surface of a layer of a yarn of a winding package 56 to provide a turning force to the take-up tube 55 or the winding package 56. Reference numeral 57 denotes a traverse guide which makes a reciprocal motion in opposite directions perpendicular to the plane of the drawing. Reference numeral 58 denotes a belt supporting member which supports thereon the transport conveyor belt 23 for wound up packages described hereinabove. Reference numerals 59 and 60 denote each a guide member, and a wound up package 61 is rolled on the guide members 59 and 60 from a wound up position to a position on the conveyor 23.

Construction of the cradle arm 54 will be described below. It is to be noted that the two-for-one twisters arranged in a back-to-back relationship have the entirely same structure including the cradle arm 54 described in detail below but have a mutually mirror image relationship with respect to the center line (plane) of the machine frames. Further, as for the cradle arms 54, they are the same in construction while they have forward and backward relationships in FIG. 1 on the two machine frames. In the followings, description will be given only of the cradle arm 54 of the left-hand side one of the machine frames in FIG. 1 while description of the cradle arm 54 on the right-hand side in FIG. 1 is omitted herein with a suffix a added to a like reference numeral of a like member.

A pair of support shafts 70 and 70*a* are disposed above the friction roller 53 and extend along the two-for-one twisters 2 arranged in a juxtaposed relationship in two rows. A cylindrical base end portion 71 of the cradle arm 54 is supported for pivotal motion on the support shaft 70*a* on the machine frame on the back side. The cradle arm 54 is composed of an arm portion 72 and a take-up tube gripping portion 73 securely mounted in an integral relationship at an end of the arm portion 72, and the gripping portion 73 is adapted to grip a take-up tube between a pair of opposing plates 74 and 75 thereof. A leaf spring 76 is interposed between the pair of plates 74 and 75, and the plates 74 and 75 are adapted to move toward and away from each other. Reference numerals 77 and 78 denote each a take-up tube arresting portion. The cradle arm 54 is supported at the base end portion 71 thereof on the support shaft 70 above the partner side and passes a location above the support shaft 70 on its own side and then depends in the vertical direction (in the case that a take-up tube is empty.)

A large plate 80 is securely mounted on the cylindrical base end portion 71. Meanwhile, a tubular body 81 is inserted for rotation in the other support shaft 70, and a small plate 82 and a connecting bar 83 are securely mounted on the tubular body 81. The opposite end portions of a turnbuckle 84 are supported for pivotal motion on the large plate 80 and the small plate 82. A contacting pressure decreasing weight 85 is securely mounted at an end of the connecting bar 83.

An upper end of the large plate 80 has a sectoral shape centered at the support shaft 70*a*, and a pair of recessed grooves 86 and 87 are formed at the opposite end portions of the same. On a bracket 88 on the machine frame side, a pin 91 which is urged downwardly by a spring 90 is held in contact with the upper end of the large plate 80.

A base portion of a cylinder 92 is supported at 93 for pivotal motion on the bracket 88, and an end of a piston rod 94 of the cylinder 92 is supported at 95 for pivotal motion on the arm portion 72. It is to be noted that reference numeral 96 denotes a limit switch installed on the machine frame side by way of a bracket 97, and when a winding package is brought into a fully wound condition, a detecting dog 98 securely mounted on the arm portion 72 kicks the switch 96 so that the switch 96 develops a fully wound signal. In the case of the present embodiment, a red lamp 99 is lit. It is to be noted that reference numeral 100 denotes a stock for empty take-up tubes.

With the construction described above, a yarn to which a twist has been applied is wound onto a take-up tube gripped by the take-up tube gripping portion 73 of the cradle arm 54. Thereupon, due to the moment of the force of the weight 85 in the clockwise direction in FIG. 2 around the support shaft 70, the cradle arm 54 is acted upon by a force in a direction to tend to pull up the cradle arm 54, that is, in a direction to decrease the contacting pressure of the winding package 56 against the friction roller 53, by way of the small plate 82, turnbuckle 84 and large plate 80.

As the winding diameter of the winding package increases, the cradle arm 54 is lifted so that the large plate 80 is tilted in the clockwise direction whereupon the inclined angle $\theta$ of the weight 85 with respect to a horizontal line decreases by way of the turnbuckle 84 and small plate 82. In short, as the winding diameter of the winding package increases, the angle $\theta$ decreases so that the value of $L\cos\theta$ increases and the moment force of the weight 85 increases. It is to be noted that the symbol L appearing as above is the distance from the center of the weight 85 to the support shaft 70, and an increase of the diameter of a winding package means an increase of the weight of the package and also of the contacting pressure of the package against the friction roller 53, and as the moment force of the weight 85 increases as a decreasing force to the contacting pressure as described above, the contacting pressure is held constant irrespective of the winding diameter.

A winding package 56 which has been fully wound up is released from the cradle arm 54 and discharged onto the conveyor 23 as the plate 75 of the take-up tube gripping portion 73 of the cradle arm 54 is pushed open against the leaf spring 76 either by an operator or by a device not shown. After then, a take-up tube 55 stored in the stock 100 is fed to the take-up tube gripping portion 73, and the cylinder 92 is rendered operative to extend the piston rod 94 from the cylinder 92 so that the cradle arm 72 is lowered to bring the take-up tube 55 into contact with the friction roller 53, thereby starting winding. Upon starting of winding and when the winding package is brought into a fully wound condition, the pin 91 is fitted into the recessed grooves 86 and 87, respectively, so that the cradle arm 54 is arrested at its position, and the position is maintained during threading of a yarn onto the take-up tube before starting of winding or during discharging of a fully wound package after it has been brought into a fully wound condition.

By the way, with the cradle arm 54 having such a construction and operation as described above, a substantially square spacing is defined by the two support shafts 70 and 70*a* and the two friction rollers 53 and can be utilized for feeding of a fully wound package 61 therein, and accordingly it is possible to produce a package 61 having a significantly large winding diameter. In other words, the cradle arm 54 has a construction wherein the outside of the substantially square spacing is a spacing for movement of the cradle arm 54 and the cradle arm 54 does not advance into the inside of the substantially square spacing. Further, as also apparently seen from FIG. 2, such a package 61 of a large winding diameter as described above can be transported without altering the width D or size of the machine frame 110 of an existing equipment.

Figure 2:
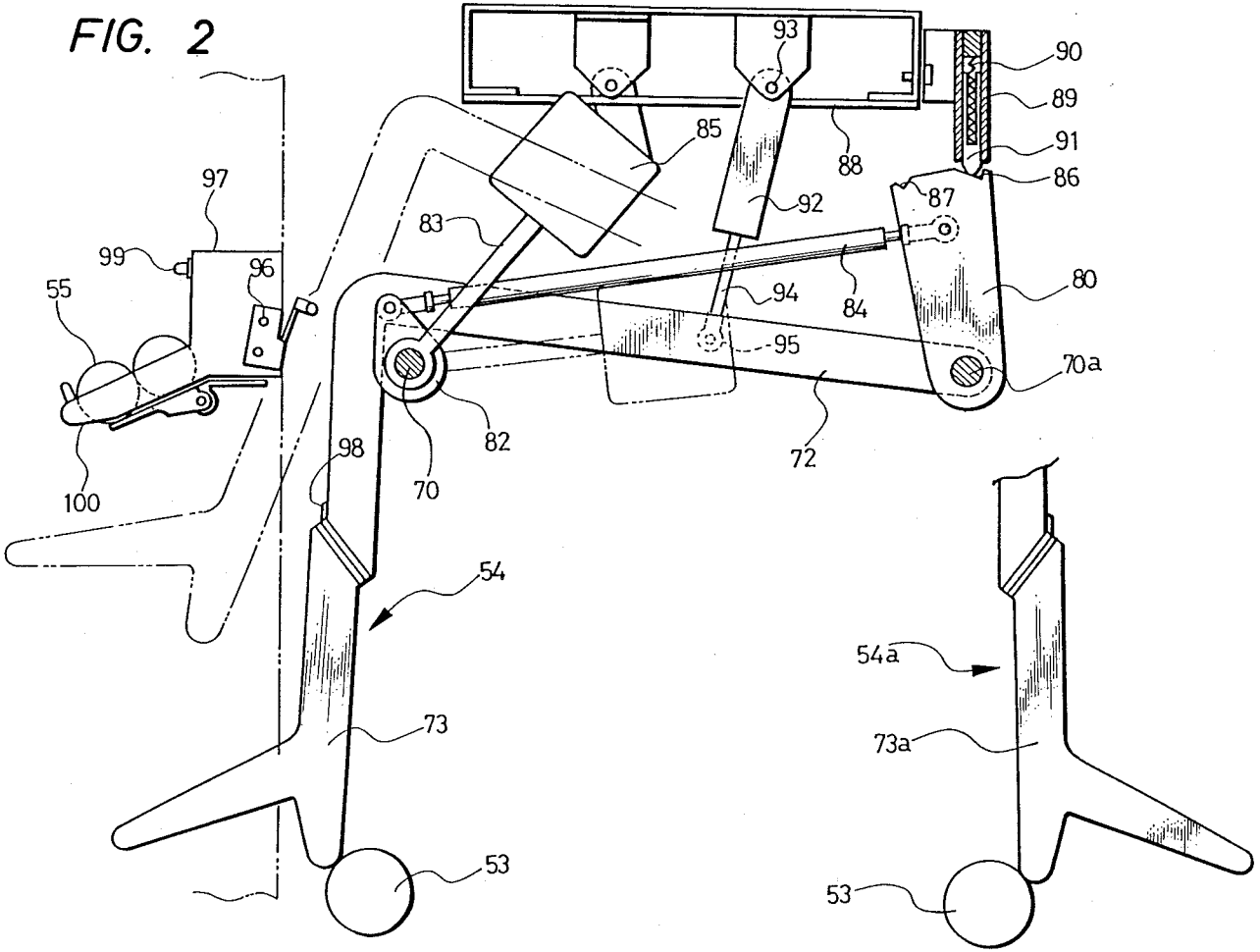
Figure 3:
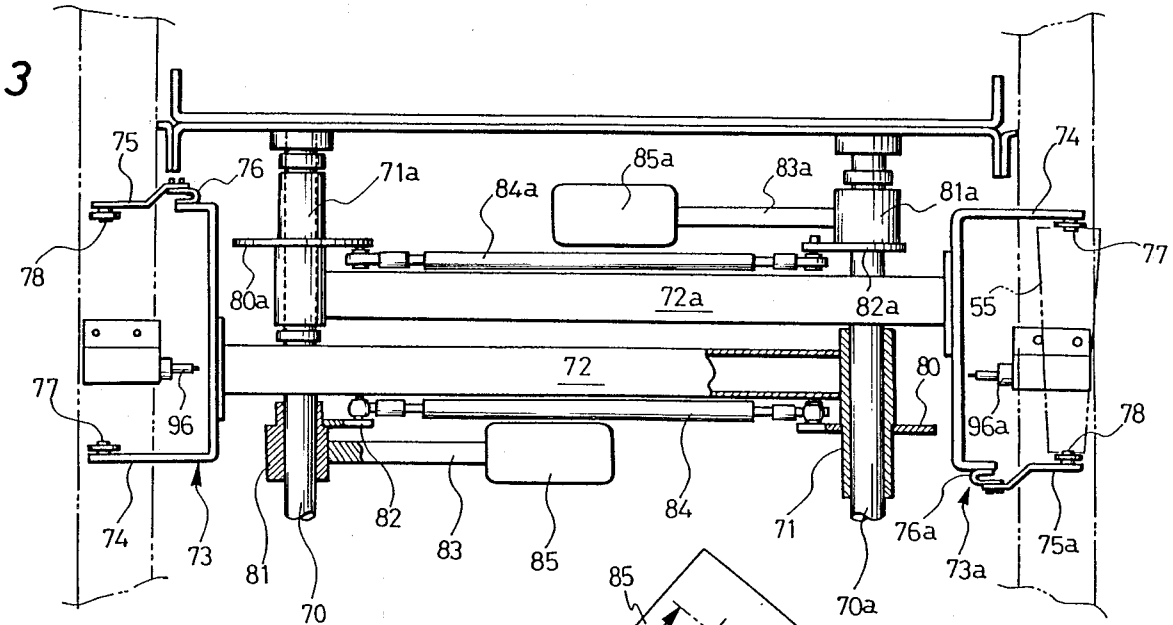
Figure 4:
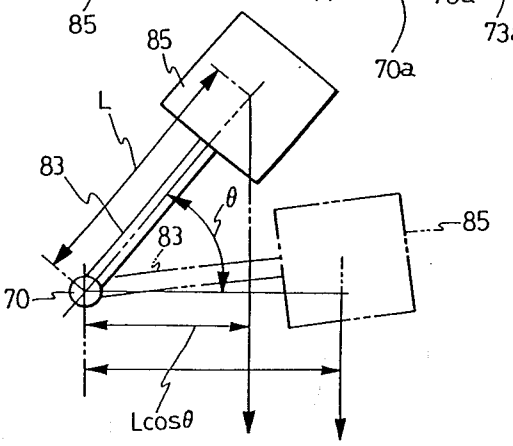

Further, since the cradle arm 54 is supported on and pivoted around the support shaft 70*a* on the back side, the locus of movement of a paper tube 55 gripped on the cradle arm 54 when the diameter of a package thereon increases as winding proceeds is such a locus extending substantially in a vertical direction as indicated by a two-dot chain line P in FIG. 2. Meanwhile, the locus of a take-up tube 55 where a base portion of the cradle arm 54 is supported for pivotal motion otherwise on the support shaft just above the same not on the back side is such a locus extending substantially in a horizontal direction as indicated by two-dot chain line Q. The difference between the loci not only causes a difference of whether the diameter of a package being wound increases substantially in the upward direction or in the forward direction but also influences the position of the feed roller 52 relative to the friction roller 53. In particular, a yarn fed from the feed roller 52 must be wound on a locus which coincides with a common tangential line at a contact point between the friction roller 53 and the winding package. Accordingly, in the case of the locus P of the take-up tube 55, the feed roller 52 will be positioned at a position substantially horizontally obliquely forwardly of the friction roller 53, while in the case of the locus Q of the take-up tube 55, the feed roller 52 will be positioned at a position substantially below the friction roller 53. Accordingly, if the distance between the feed roller 52 and the friction roller 53 is constant, this will have an influence on the height of the entire machine frame, but if the height of the entire machine frame is constant, this will have an influence on the distance between the support shaft and the friction roller 53, and the distance is greater where the base portion of the cradle arm 54 is supported for rotation on the support shaft on the back side, which makes it possible to cope with a package of a large winding diameter accordingly.

As apparent from the foregoing description, according to the present invention, a wide spacing is provided at an intermediate position between winding packages on machine frames arranged in a back-to-back relationship in two rows, and accordingly it becomes possible to make the most of the intermediate position as a spacing for transportation of winding packages therethrough.

What is claimed is:

1. A two-for-one twisting machine having a plurality of twister units, each twister unit being associated with a respective friction roller and having a front side and a back side, the twister units being arranged in a back-to-back relationship in first and second rows, the two-for-one twisting machine comprising:

first and second support extending above the friction rollers associated with the first and second rows of said twister units, respectively, wherein the first support shaft is arranged adjacent the front side of the twister unit of the first row and is arranged toward the back side of the twister units of the second row, and wherein the second support shaft is arranged adjacent the front side of the twister units of the second row and is arranged toward the back side of the twister units of the first row, and a plurality of individual cradle arms for twister units of both said first and second rows, each cradle arm associated with a respective twister unit and having a base end portion, each cradle arm being supported for pivotal motion at the base end portion thereof on the support shaft arranged toward the back side of the twister unit with which the cradle arm is associated.

2. A two-for-one twisting machine having a plurality of twister units each twister unit provided with a respective friction roller, the twister units being arranged in a back-to-back relationship in first and second rows, the two-for-one twisting machine comprising:

first and second support shafts provided above the friction rollers and along said first and second rows of twister units, respectively, wherein the first support shaft is arranged farther from the second row than the first row of twister units, and the second support shaft is arranged farther from the first row than the second row of twister units, and a plurality of cradle arms for twister units of both said first and second rows each cradle arm associated with a respective twister unit and having a base end portion, each cradle arm for supporting a package and being supported for pivotal motion on the support shaft which is arranged farther from said twister unit with which the cradle arm is associated.

3. A two-for-one twisting machine as claimed in claim 2, further comprising:

a transport conveyor belt for wound up packages provided within a substantially rectangular space defined by said two support shafts and friction rollers of each row of the twister units, the transport conveyor belt extending along the twister units.

4. A two-for-one twisting machine as claimed in claim 2, wherein said cradle arm comprises:

a L-shaped arm portion secured to the base end portion, and a take-up tube gripping portion securely mounted in an integral relationship at an end of the arm portion, said arm portion being constructed to pass above the support shaft arranged nearer to the winder unit with which the cradle arm is associated upon the cradle arm being pivotally moved about the other support shaft.

5. A two-for-one twisting machine as claimed in claim 4, wherein said take-up tube gripping portion of a cradle arm is lifted along a locus of movement extending substantially in a vertical direction when the diameter of a package increases as winding proceeds in the winder unit with which the cradle arm is associated, and wherein each winder unit is provided with a respective feed roller position substantially on a common tangential line at a contact point between the friction roller and the winding package associated with the winder unit, and at a position obliquely downwardly of the friction roller by an angle of about 45 degree.

6. A two-for-one twisting machine as claimed in claim 4, wherein said take-up tube gripping portion includes a pair of opposing plates and a leaf spring interposed between the pair of plates wherein the plates are adapted to move toward and away from each other to grip a take-up tube therebetween or to release it.

7. A two-for-one twisting machine as claimed in claim 4, further comprising:

a first plate secured to the base end portion of the cradle arm, a cylindrical member supported for rotation about one of the support shafts, a second plate secured with the cylindrical member, a connecting bar secured with the cylindrical member, and a turnbuckle supported for pivotal motion on the first plate and the second plate.

8. A two-for-one twisting machine as claimed in claim 7, further comprising a contacting pressure decreasing weight provided at an end of said connecting bar, wherein contacting pressure of the winding package against the friction roller can be controlled by way of the second plate, turnbuckle and the first plate.

9. A two-for-one twisting machine as claimed in claim 8, wherein the first plate has an upper end provided with two opposite end portions, a sectoral shape substantially centered at the support shaft and a pair of recessed grooves formed at the opposite end portions of the upper end.

10. A two-for-one twisting machine as claimed in claim 9, further comprising a spring and a pin urged downwardly by the spring and held in contact with the upper end of the first plate, the pin adapted to be fitted into one of the recessed grooves so that the pivotal motion of the cradle arm can be arrested during threading of a yarn onto a take-up tube or during discharging of a fully wound package.

* * * * *